US009080357B1

(12) United States Patent
Austin, III

(10) Patent No.: US 9,080,357 B1
(45) Date of Patent: Jul. 14, 2015

(54) SHOWER DOOR HINGE

(71) Applicant: LIBERTY HARDWARE MFG. CORP., Winston-Salem, NC (US)

(72) Inventor: James Allen Austin, III, High Point, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 44 days.

(21) Appl. No.: 14/166,002

(22) Filed: Jan. 28, 2014

(51) Int. Cl.

| | |
|---|---|
| ***E05D 5/02*** | (2006.01) |
| ***E05D 7/12*** | (2006.01) |
| ***E05D 15/00*** | (2006.01) |
| ***E06B 3/34*** | (2006.01) |
| ***A47K 3/30*** | (2006.01) |

(52) U.S. Cl.
CPC ... *E05D 7/12* (2013.01); *A47K 3/30* (2013.01); *E05D 15/00* (2013.01); *E06B 3/34* (2013.01)

(58) Field of Classification Search
CPC ..... E05D 5/0246; E05D 2005/0261; E05D 2005/0269; E05D 7/081; E05D 7/08; E05Y 2900/114; E05Y 2600/502; E05Y 2600/60; E05F 11/385; E06B 3/54; A47K 3/362; A47K 2003/367; A47F 3/12; A47F 3/125; Y10T 16/534; Y10T 16/5326; Y10T 16/554
USPC ..... 16/252, 247, 382, 383, 387, 388, 390; 49/398, 399, 501; 4/556, 607, 614, 557
See application file for complete search history.

(56) References Cited

U.S. PATENT DOCUMENTS

| | | | | |
|---|---|---|---|---|
| 2,154,716 | A * | 4/1939 | Anderson | 16/247 |
| 3,229,323 | A * | 1/1966 | Hensgen | 16/247 |
| 4,200,956 | A * | 5/1980 | Ullman, Jr. | 16/235 |
| 4,286,352 | A | 9/1981 | Pittasch | |
| 4,513,474 | A | 4/1985 | Watabe | |
| 4,639,971 | A * | 2/1987 | Kurtz | 16/247 |
| 4,689,853 | A * | 9/1987 | Marinoni | 16/382 |
| 4,914,888 | A | 4/1990 | Hanson | |
| 4,977,642 | A * | 12/1990 | Marinoni | 16/257 |
| 5,613,276 | A * | 3/1997 | Franz | 16/229 |
| 5,675,936 | A | 10/1997 | Kurth et al. | |
| 5,848,446 | A | 12/1998 | DeBraal | |
| 5,855,042 | A * | 1/1999 | Bruckner | 16/252 |
| 6,161,255 | A * | 12/2000 | Garrett | 16/284 |
| 6,178,595 | B1 * | 1/2001 | Marinoni | 16/252 |
| 6,560,821 | B2 | 5/2003 | Miller et al. | |
| 6,643,898 | B1 | 11/2003 | Cameron et al. | |
| 6,704,966 | B1 | 3/2004 | Kao | |
| 6,912,818 | B2 | 7/2005 | Sprague | |
| 7,305,797 | B2 * | 12/2007 | Chiang | 49/388 |

(Continued)

*Primary Examiner* — Chuck Mah
(74) *Attorney, Agent, or Firm* — Brooks Kushman P.C.; Lora Graentzdoerffer

(57) ABSTRACT

A clamp assembly includes a shoe having a base member and first and second side walls forming a first channel, and a first plurality of threaded fasteners extending parallel to a lateral axis. The first side wall has an interior surface with first and second contact surfaces extending longitudinally. A gasket forms a second channel sized to receive a glass panel and sized to be received within the first channel. A clamping bracket has a first side and a second opposed side, where the first side has third and fourth contact surfaces extending longitudinally and shaped to engage with the first and second contact surfaces. A second plurality of threaded fasteners cooperate with the first plurality of fasteners to clamp a glass shower door panel in the gasket. At least one of the first, second, third and fourth contact surfaces is angled relative to the lateral axis.

20 Claims, 3 Drawing Sheets

(56) References Cited

U.S. PATENT DOCUMENTS

| | | | | |
|---|---|---|---|---|
| 7,493,673 | B2 | 2/2009 | Garrett | |
| 7,607,199 | B2 | 10/2009 | Sprague | |
| 7,748,527 | B2 | 7/2010 | Wisecarver et al. | |
| 7,828,151 | B2 | 11/2010 | Murdoch et al. | |
| 8,578,557 | B2 * | 11/2013 | Yu | 16/55 |
| 2006/0137140 | A1 * | 6/2006 | Christeson et al. | 16/247 |
| 2006/0284522 | A1 * | 12/2006 | Burke et al. | 312/116 |
| 2008/0000158 | A1 * | 1/2008 | Ranelli et al. | 49/209 |
| 2008/0168621 | A1 | 7/2008 | Lin | |
| 2009/0126169 | A1 * | 5/2009 | Nielsen | 24/486 |
| 2011/0214254 | A1 * | 9/2011 | Fellman | 16/252 |
| 2012/0079682 | A1 | 4/2012 | Cheng | |
| 2013/0325670 | A1 | 12/2013 | Austin, III et al. | |
| 2015/0043965 | A1 * | 2/2015 | Mao-Cheia | 403/338 |

* cited by examiner

SHOWER DOOR HINGE

TECHNICAL FIELD

Various embodiments relate to a hinge assembly for a glass shower door.

BACKGROUND

A shower or other bathing area may have a door to enclose the area and also to contain liquid water and/or steam within the shower area. A shower installation may have various designs and are often include glass walls and/or doors that provide a desired aesthetic, allow the passage of light into the shower area, and are also easy to clean, etc. Some of the glass panels for the walls and the door may be installed without a frame extending around the glass, or in a frameless manner. The glass used may be tempered to strengthen the glass for use in this application. For a frameless glass panel door, the door is fit within the doorway or a door frame to the shower installation, and is supported or hung onto an adjacent structure in doorway using hinges that both support the door and allow it to pivotally open and close. The hinges may connect the door to a door jamb, or alternatively may be connected to a header and a floor member.

For a conventional, frameless, glass panel door, a glass plate is drilled, cut, or otherwise formed with apertures, cutouts, or the like for use in connecting the hinge to the door prior to tempering. After tempering, or annealing, the glass becomes more difficult to work with as any cutting process requires heating the glass and risking the integrity of the panel.

For a glass panel used in a shower application, such as a frameless door, the doors are often provided in limited size and shape options for the user or consumer to select from, and with predetermined or precut shapes for attaching the hinge hardware. Alternatively, the door panel may custom made to fit an unusual doorway area or shape, which requires additional time and cost.

SUMMARY

According to an embodiment, a clamp assembly is provided with a shoe having a base member and first and second side walls forming a first channel extending along a longitudinal axis of the shoe. The shoe has a first plurality of threaded fasteners extending parallel to a lateral axis of the shoe. The first side wall of the shoe has an interior surface with first and second contact surfaces extending longitudinally. A gasket is provided and forms a second channel sized to receive a glass panel and sized to be received within the first channel. A clamping bracket is formed by a member having a first side and a second opposed side. The first side of the clamping bracket has third and fourth contact surfaces extending longitudinally that are shaped to engage with the first inclined and second contact surfaces. A second plurality of threaded fasteners is sized to cooperate with the first plurality of threaded fasteners to clamp a glass shower door panel in the gasket. At least one of the first, second, third, and fourth contact surfaces is angled relative to the lateral axis.

According to another embodiment, a hinge assembly for a glass panel is provided. A shoe has a base member positioned between a first side wall and a second side wall to form a first channel. The first side wall of the shoe defines at least one threaded aperture. The first side wall of the shoe has an interior surface facing the second side wall that defines a first inclined ramp extending longitudinally in the channel. A gasket has a base member, a first side member, and a second side member forming a second channel. The second channel of the gasket is sized to receive an edge portion of a glass shower door panel. The gasket is sized to fit within the first channel of the shoe. A clamping member has a first side and a second opposed side. The first side of the clamping member is adjacent to the interior surface of the first side wall of the shoe and the second side is adjacent to the first side member of the gasket. The first side of the clamping member has a second inclined ramp extending longitudinally and is shaped to engage with the first inclined ramp of the interior surface of the shoe. At least one threaded fastener is sized to be received in the at least one threaded aperture. An end of the fastener is in contact with the first side of the clamping member to provide a lateral force on the clamping member, through the gasket, and to the panel.

According to yet another embodiment, a hinge assembly for a glass shower door panel is provided. A shoe has a base member and first and second side walls forming a first channel extending along a longitudinal axis of the shoe. The first side wall of the shoe defines a plurality of threaded apertures extending parallel to a lateral axis of the shoe. The first side wall of the shoe has an interior surface with first and second inclined planes extending longitudinally and on either side of the apertures. A first vector normal to the first inclined plane has a component perpendicular to the lateral and longitudinal axes. A second vector normal to the second inclined plane has a component perpendicular to the lateral and longitudinal axes. A gasket forms a second channel sized to receive a glass panel and sized to be received within the first channel. A clamping bracket is formed by a member having a first side and a second opposed side. The first side of the clamping bracket has third and fourth inclined planes extending longitudinally and shaped to engage with the first inclined and second inclined planes. A plurality of threaded fasteners is sized to be received in the threaded apertures.

Various embodiments of the present disclosure have associated, non-limiting advantages. For example, a rotational motion of a panel within the gasket about the lateral axis provides a frictional force between the gasket and the clamping bracket to force the bracket in a lateral direction towards the panel to provide additional clamping force on the panel due to at least one of the first, second, third and fourth contact surfaces being angled relative to the lateral axis. Also, the clamping assembly of the hinge may be used with an array of glass panels as the panel does not need any precut or predrilled mounting points for use with the hinge. Additionally, the hinge may be positioned anywhere along the edge of the panel, thereby providing additional flexibility during installation.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 2:
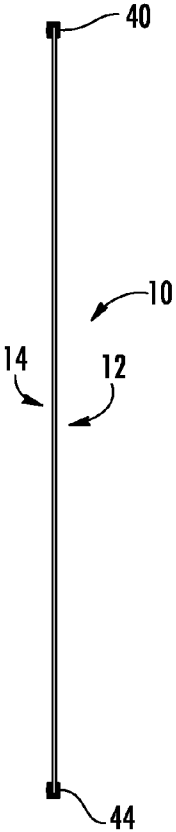
FIG. 2 illustrates a side view of the door and a portion of the hinge assembly connected to the door of FIG. 1.
Figure 1:
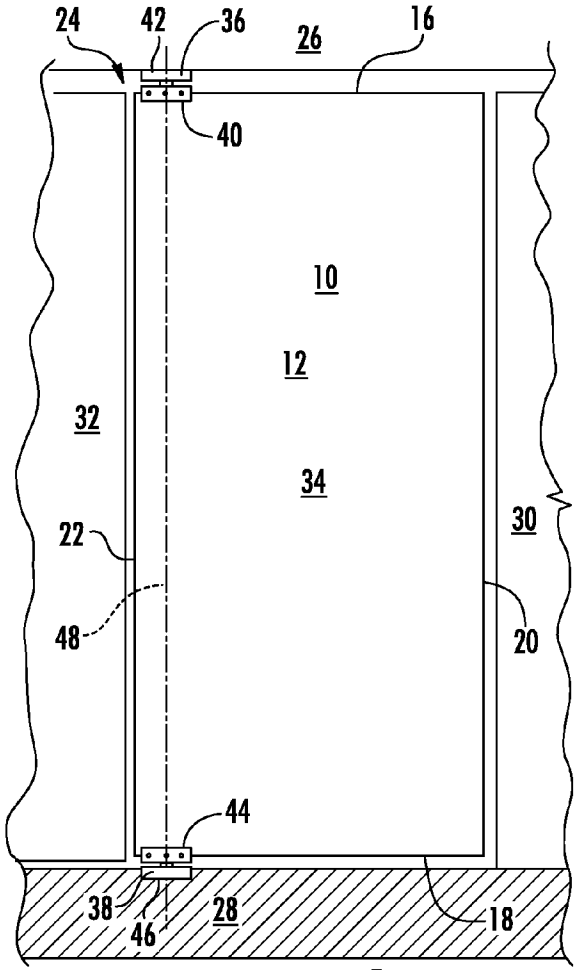
FIG. 1 illustrates a front perspective view of a frameless glass shower door according to an embodiment.
Figure 7:
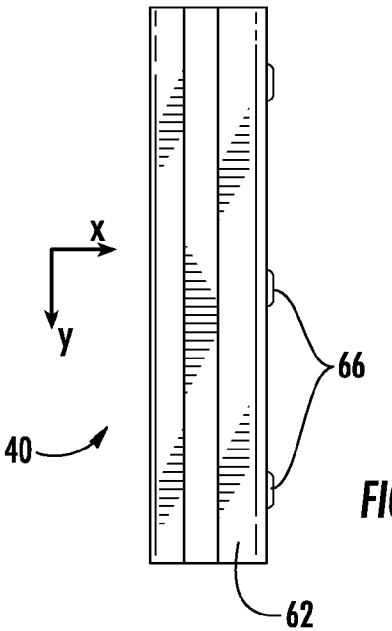
FIG. 7 illustrates a top perspective view of the hinge assembly of FIG. 4.
Figure 8:
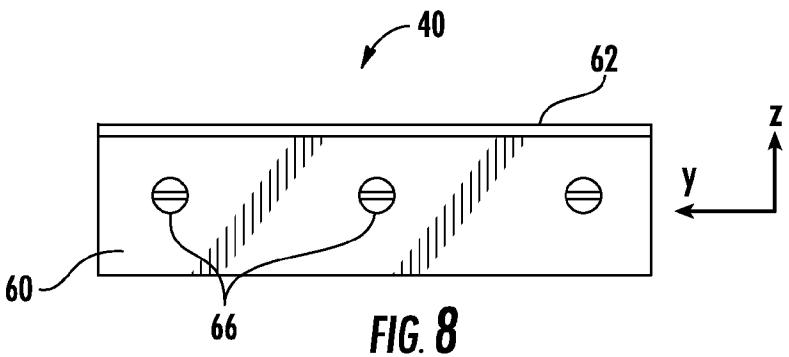
FIG. 8 illustrates a front perspective view of the hinge assembly of FIG. 4.
Figure 4:
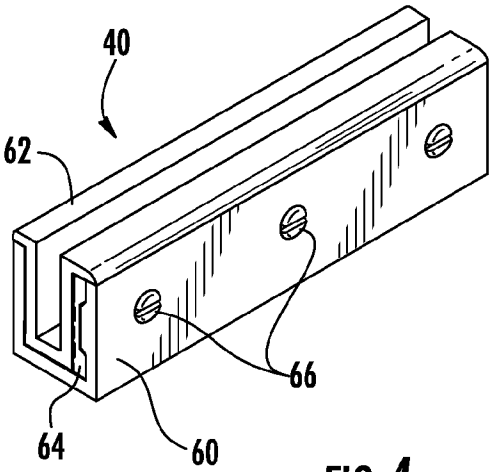
FIG. 4 illustrates a perspective view of the portion of the hinge assembly of FIG. 3.

FIGS. 1 and 2 illustrate an embodiment of a frameless glass shower door panel 10. The panel 10 is made from glass, such as tempered or annealed glass. The panel 10 has a front surface 12 and a rear surface 14 opposed from and generally parallel with the front surface. The panel 10 has a top edge 16, a bottom edge 18, and two side edges 20, 22. In other embodiments, the glass panel door 10 may be used as a door elsewhere in a residence or a commercial space, for example, as a door to a steam room, a conference room, or the like. The door 10 may also be used as a glass door in a cabinet or other furniture.

The door panel 10 is fitted within a door frame 24. In the example shown, the door frame 24 has a header 26, a floor member 28, and two door jambs 30, 32. The door panel 24 is sized to be received into the door frame 24. The header 26 may be a structural element for a shower, and may be plaster, tile, or the like. The floor member 28 may be tile, stone, or another suitable flooring or other material, and may be a threshold.

A door assembly 34 includes the panel 10 and first and second hinges 36, 38. The hinges 36, 38 may be mounted on the upper and lower edges 16, 18 of the door 10, as shown. The jambs 30, 32 may be made from a glass panel similar to panel 10, or may be tiled walls, etc. Alternatively, the hinges 36, 38 may be mounted on one of the side edges of the door, such as edge 22 and connect to one of the jambs, such as jamb 32.

Each hinge assembly 36, 38 has an assembly 40, 44, such as a clamp assembly or hinge assembly, that connects to the panel 10 of the door assembly 34. The hinges 36, 38 may be identical to one another or may be mirror images of one another. Each hinge assembly also has an assembly 42, 46 that connects to the frame 24. The two assemblies 40, 42 of the first hinge 36 are pivotally and mechanically connected to one another. The two assemblies 44, 46 of the second hinge 38 are pivotally and mechanically connected to one another. The door assembly 34 is hung and fitted in the frame 24 using the hinges 36, 38. The hinges 36, 38 allow the door panel 10 to pivot or rotate about an axis of rotation 48. The door may only swing to one side of the frame 24, or ay open and swing to both sides of the frame 24.

Figure 3:
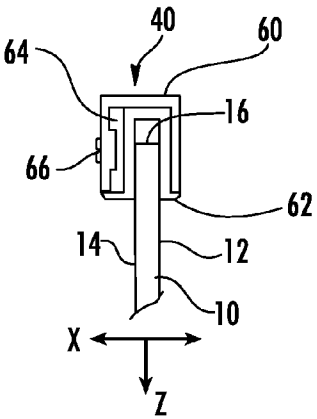
FIG. 3 illustrates a detailed view of the shower door and the portion of the hinge assembly of FIG. 2.

FIG. 3 illustrates a side view of the hinge assembly 40 connected to a panel 10. FIGS. 4-8 illustrate various views of the hinge assembly 40. Hinge assembly 44 appears the same as or similar to FIG. 3. The hinge assembly 40 is illustrated as being connected to the top edge 16 of the panel 10. In alternative embodiment, the hinge assembly 40 may be connected to one of the other edges 18, 20, 22 of the panel 10, and at various locations along the edges 16, 18, 20, 22.

The hinge assembly 40 has a clamping shoe 60, a clamping gasket 62, a clamping bracket 64, and a plurality of fasteners such as set screws 66. The hinge assembly is described with respect to a Cartesian coordinate system including a lateral or transverse axis (x), a longitudinal axis (y), and a third axis (z), which may be a vertical axis (as shown) or a horizontal axis if the hinge 40 is installed on edge 20 or 22.

The clamping shoe 60 is formed by a base member 68 and two side members or side walls 70, 72 that provide a channel 74. The clamping shoe 60 may be made from a metal, such as aluminum, or another material. The shoe 60 may have a decorative finish. The channel 74 extends along a longitudinal axis (y) of the hinge. The base member 68 and the side walls 70, 72 may be positioned generally perpendicularly to one another, and may form a U-shaped channel.

The first side wall 70 defines a first plurality of threaded fasteners 76, such as threaded apertures, extending parallel to a lateral axis (x) of the shoe. Each of the threaded apertures 76 extends through the first side wall 70. The thread pattern on the apertures 76 corresponds and engages with the thread pattern on the second plurality of fasteners, such as set screws 66.

Figure 6:
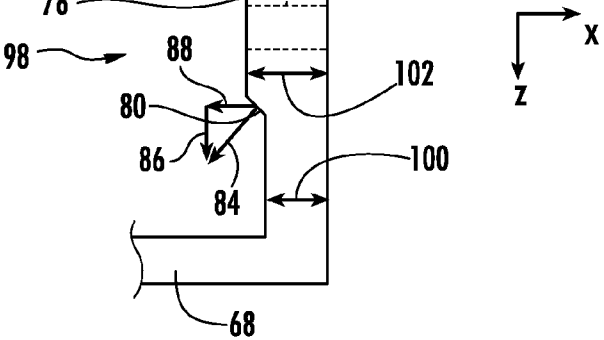
FIG. 6 illustrates a partial side view of the hinge assembly of FIG. 4.
Figure 5:
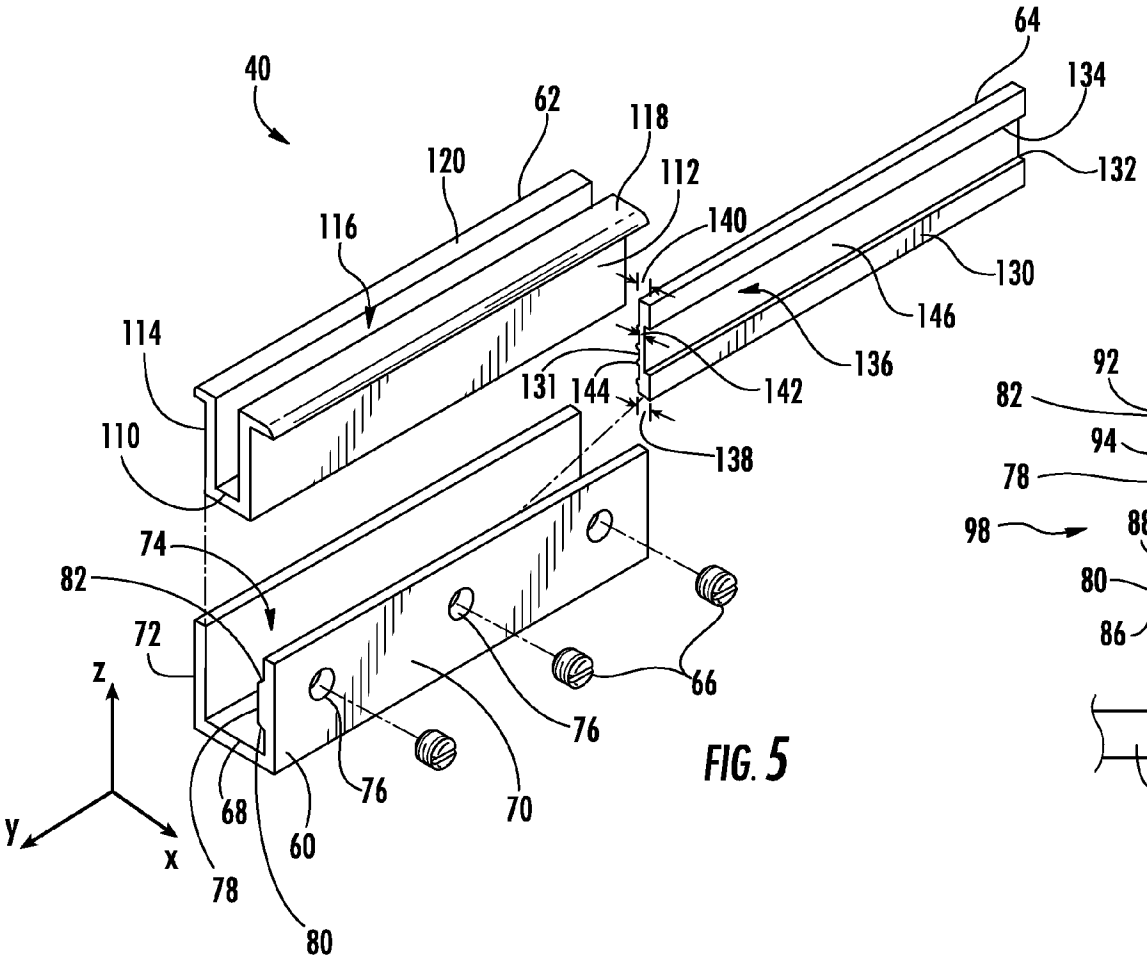
FIG. 5 illustrates an exploded view of the hinge assembly of FIG. 4.

In one example, the first side wall 70 has an interior surface 78 with first and second contact surfaces 80, 82. The contact surfaces 80, 82 may be inclined planes or ramps extending longitudinally and on either side of the apertures 76. In other embodiments, the contact surfaces 80, 82 may be positioned on the other side wall and opposite to the apertures to interact with, for example, a second clamping bracket. The contact surfaces 80, 82 may be planar, or alternatively, may incorporate a curved profile. The first inclined plane 80 has a first vector 84 normal to the first inclined plane with a first component 86 perpendicular to both the lateral and longitudinal axes, or in the vertical axis (z). A second component 88 of the first vector 84 is parallel with the lateral axis (x). The second inclined plane 82 has a first vector 90 normal to the first inclined plane with a first component 92 perpendicular to both the lateral and longitudinal axes, or in the vertical axis (z). A second component 94 of the second vector 90 is parallel with the lateral axis (x). As can be seen in FIG. 6, the inclined ramps 80, 82 may be nonparallel to one another, and may or may not be perpendicular to one another. In other embodiments, the interior surface 78 may have only one contact surface, such as plane 80, or the contact surfaces may be positioned otherwise with respect to the apertures.

In one example, the first inclined ramp 80 may be positioned between the apertures 76 and the base member 68 of the shoe. The second inclined ramp 82 may be positioned between the apertures 76 and a free end 96 of the first side wall 70 opposed to the base member 68. The ramps 80, 82 form a convex protrusion 98 on the interior surface 78 of the first wall 70.

The first side wall 70 has a first thickness 100 adjacent to the base member 68, a second thickness 102 adjacent to the apertures 76, and a third thickness 104 adjacent to the free end 96. The second thickness 102 is greater than the first and third thicknesses 100, 104. The first and third thickness 100, 104 may be equal to one another or may be different dimensions.

The gasket 62 has a base member 110, a first side member 112, and a second side member 114. The members 110, 112, and 114 form a second channel 116 that is sized to receive an edge portion of a glass shower door panel 10. The second channel 116 may be generally U-shaped as shown, with the side members 112, 114 generally perpendicular to the base member 110. The gasket 62 is sized to fit within the first channel 74 of the shoe 60. The gasket may be made of a natural or synthetic rubber, a silicone material, a polymer, or another flexible material as is known in the art.

The gasket 62 has a first lip 118 extending outwardly from the first side member 112. The first lip is sized to extend over the bracket 64 and the first wall 70. The gasket also has a second lip 120 extending outwardly from the second side member 114. The second lip 120 is sized to cover a free end of the second side wall 72 of the shoe.

The clamping bracket or clamping member 64 has a first side 130 and a second opposed side 131. The clamping bracket 64 is positioned between the gasket 62 and the shoe 60. The first side of the 130 is adjacent to the interior surface 78 of the first side wall 70 of the shoe 60. The second side 131 is adjacent to the first side member 112 of the gasket. The fasteners 66, such as set screws, extend through the apertures 76 and impart a force on the first side 130 of the bracket 64. The bracket is forced against the gasket and provides a distributed force, or pressure on the first side member 112 of the gasket 62 to retain the panel 10 in the hinge assembly 40. The bracket 64 is a rigid member, and may be made from a metal or another material with sufficient stiffness.

The first side 130 has contact surfaces 132, 134, such as inclined ramps or planes, that extending longitudinally along the bracket 64. The number and shape of the contact surfaces 132, 134 correspond with those of the shoe 60. The contact surfaces 132, 134 are shaped and positioned to engage with the contact surfaces 80, 82 of the interior surface 78 of the shoe 60. Inclined plane 132 has a normal vector that is directly opposed to vector 84 on inclined plane 80. Inclined plane 134 has a normal vector that is directly opposed to vector 90 on inclined plane 82. The surface of the first side 130 is constructed such that its surface abuts the interior surface 78.

The contact surfaces 132, 134 may be planar or otherwise shaped and are based on the shape of the ramps 80, 82 of the shoe. The inclined ramps 132, 134 form a concave groove 136.

The bracket member 64 has a first thickness 138 at one end, and a second thickness 140 at the opposed end. The intermediate region of the bracket member has a third thickness 142 that is less than the first and second thicknesses 138, 140. In combination, the first side wall 70 and the bracket 64 may have a constant thickness in the lateral direction (x) in one example.

The second side 131 of the bracket has a series of projections 144 extending outwardly therefrom to interact with the gasket 62 and provide improved clamping of the panel 10. The series of projections 144 may be linear or otherwise shaped ridges, or other shaped projections.

To connect a hinge assembly 40 to a panel 10, the bracket 64 is placed on the interior surface 78 of the shoe 60 such that the inclined ramps 80, 82, 132, 134 align and engage. The gasket is then placed into the channel 74 such that the first side member 112 of the gasket 62 is in contact with or adjacent to the second side 131 of the bracket 64. At this point, the bracket 64 is positioned between the first side member 112 of the gasket 62 and the first wall 70 of the shoe 60. The pane 10 may then be placed into the gasket 62 until the edge 16 of the pane 10 is abutting the base 110 of the gasket 62, or at a desired or predetermined distance from the base 110. The panel 10 does not have any cutouts such as holes or the like for use in the attachment of a hinge or other hanging or mounting hardware.

The set screws or other fasteners 66 are inserted and threaded into the apertures 76 until the inside end of the fastener 66 abuts and presses against the central region 146 of the bracket 64. The point forces from the fasteners 66 are distributed by the bracket 64 to provide a generally even or distributed pressure to the first side member 112 of the gasket 62. The pane 10 is then compressed by the first side member 112 and also by the second side member 114 of the gasket. The hinge assembly 40 provides a pressure clamping of the pane within the assembly 40.

Furthermore, a rotational motion about the lateral axis (x) of the panel 10 within the hinge 40 provides an additional clamping force. The rotational motion of the panel 10 about the lateral axis (x) provides a frictional force between the gasket 62 and the clamping bracket 64. This causes the inclined planes 132, 134 of the bracket 64 against the respective inclined planes 80, 82 of the shoe 60. The inclined planes 80, 82 of the shoe cause the bracket 64 to move in a lateral direction towards the panel 10 and away from the shoe 60 to provide additional clamping force on the panel. The inclined ramps 80, 82 engage with the corresponding inclined ramps 132, 134 to provide a force normal to the first side member 112 of the gasket and such that the bracket 64 moves in a lateral direction to provide an additional clamping force to the panel when the panel is rotated about a lateral axis of the hinge. Therefore, the inclined ramps 80, 82, 132, 134 may act to retain and/or secure the panel 10 within the hinge assembly 40 is the fasteners 66 are loosened.

The hinge assembly 40 acts as a clamping device to a panel 10 of glass. The assembly 40 is secured to the glass panel 10 by set screws 66. The set screws 66 act on the clamping bracket 64 which transfers the pressure evenly and safely to the glass panel 10 through the clamping gasket 62. If the fasteners 66 become loose and the glass panel 10 begins to rotate out of the assembly 40, the clamp assembly 40 will tighten via the mechanism as described with respect to the ramps 80, 82, 132, 134 to help keep the glass from falling out of the assembly 40. As a glass panel 10 starts to move within the clamp assembly 40, the friction between the gasket 62 and the bracket 64 forces the bracket 64 against the incline planes 80, 82 of the clamping shoe 60. This, in turn, causes the bracket 64 to move in a direction perpendicular to the glass panel 10, or along the lateral axis (x), and helps to tighten the assembly. The hinge assembly 40 therefore mechanically tightens with the rotation of the glass panel 10.

The shower door assembly may be installed by providing a glass panel from an array of glass panels having a range of sizes. The array of glass panels maybe selected at a retail location as one of various sizes of glass panes or panels. Since the hinge does not require that the glass panel has predrilled or precut mounting points, a wider range of panels may be available for a wider range of shower openings, and the need for a custom prepared and tempered glass panel is reduced or eliminated. The glass panel selected to fit within an opening in a shower structure. A hinge having a hinge assembly is installed onto an edge region of the glass panel to form a shower door assembly as described above. The hinge is fastened to an adjacent structure in a shower to pivotally mount the door. The hinge assembly may be placed along any edge region of the shower door panel, as it does not requires any precuts in the panel, and is connected using a pressure clamping mechanism.

Various embodiments of the present disclosure have associated, non-limiting advantages. For example, a rotational motion of a panel within the gasket about the lateral axis provides a frictional force between the gasket and the clamping bracket to force the bracket in a lateral direction towards the panel to provide additional clamping force on the panel due to at least one of the first, second, third and fourth contact surfaces being angled relative to the lateral axis. Also, the clamping assembly of the hinge may be used with an array of glass panels as the panel does not need any precut or predrilled mounting points for use with the hinge. Additionally, the hinge may be positioned anywhere along the edge of the panel, thereby providing additional flexibility during installation.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A clamp assembly comprising:

a shoe having a base member and first and second side walls forming a first channel extending along a longitudinal axis of the shoe, a first plurality of threaded fasteners extending parallel to a lateral axis of the shoe, the first side wall having an interior surface with first and second contact surfaces extending longitudinally;

a gasket forming a second channel sized to receive a glass panel and sized to be received within the first channel;

a clamping bracket formed by a member having a first side and a second opposed side, the first side having third and fourth contact surfaces extending longitudinally and shaped to engage with the first and second contact surfaces; and a second plurality of threaded fasteners sized to cooperate with the first plurality of threaded fasteners to clamp a glass shower door panel in the gasket;

wherein at least one of the first, second, third and fourth contact surfaces is angled relative to the lateral axis.

2. The clamp assembly of claim 1 wherein the first, second, third and fourth contact surfaces are planes.

3. The clamp assembly of claim 1 wherein the first and second contact surfaces are inclined planes.

4. The clamp assembly of claim 3 wherein the third and fourth contact surfaces are inclined planes.

5. A clamp assembly of claim 1 wherein a rotational motion of a panel within the gasket about the lateral axis provides a frictional force between the gasket and the clamping bracket to force the bracket in a lateral direction towards the panel to provide additional clamping force on the panel due to at least one of the first, second, third and fourth contact surfaces being angled relative to the lateral axis.

6. The clamp assembly of claim 1 wherein the first side wall has a first thickness and has a second thickness less than the first thickness thereby providing the first and second contact surfaces between the first and second thicknesses.

7. A method of installing a shower door assembly comprising:

providing a glass panel from an array of glass panels having a range of sizes, the glass panel selected to fit within an opening in a shower structure;

installing a hinge having a clamp assembly according to claim 1 on an edge region of the glass panel to form a shower door assembly; and fastening the hinge to an adjacent structure in a shower.

8. The method of claim 7 wherein installing the hinge further comprises tightening the second plurality of threaded fasteners into the first plurality of threaded apertures such that an end of each of the second plurality of fasteners is forced against the clamping bracket, thereby providing a distributed clamping force on the panel through the gasket.

9. The method of claim 7 further comprising retaining the panel within the hinge during a rotational motion of the panel about the lateral axis by forcing the contact surfaces of the bracket against the contact surfaces of the shoe, thereby moving the bracket in a lateral direction towards the panel to provide additional clamping force on the panel.

10. A hinge assembly for a glass panel comprising:

a shoe having a base member positioned between a first side wall and a second side wall to form a first channel, the first side wall defining at least one threaded aperture, the first side wall having an interior surface facing the second side wall and defining a first inclined ramp extending longitudinally in the channel;

a gasket having a base member, a first side member, and a second side member forming a second channel, the second channel of the gasket sized to receive an edge portion of a glass shower door panel, the gasket sized to fit within the first channel of the shoe;

a clamping member having a first side and a second opposed side, the first side adjacent to the interior surface of the first side wall of the shoe and the second side adjacent to the first side member of the gasket, the first side having a second inclined ramp extending longitudinally and shaped to engage with the first inclined ramp of the interior surface of the shoe; and at least one threaded fastener sized to be received in the at least one threaded aperture, an end of the fastener being in contact with the first side of the clamping member to provide a lateral force on the clamping member, through the gasket, and to the panel.

11. The hinge assembly of claim 10 wherein the first and second inclined ramps engage with one another to provide a force normal to the first side member of the gasket and in a lateral direction from the clamping member to provide an additional clamping force to the panel when the panel is rotated about a lateral axis of the hinge.

12. The hinge assembly of claim 10 wherein the first inclined ramp of the shoe is positioned between the at least one aperture and the base member of the shoe.

13. The hinge assembly of claim 10 wherein the interior surface of the first side wall of the shoe has a third inclined ramp extending longitudinally in the channel; and wherein the first side of the clamping member has a fourth inclined ramp extending longitudinally and shaped to engage with the third inclined ramp of the interior surface of the shoe.

14. The hinge assembly of claim 13 wherein the first and third inclined ramps are positioned between first and second edge regions on the interior surface of the shoe, with an intermediate region interposed between the first and third inclined ramps; and wherein the first and second edge regions and the intermediate region are planar and generally parallel with one another.

15. The hinge assembly of claim 13 wherein the first and third inclined ramps form a convex protrusion on the interior surface; and wherein the second and third inclined ramps form a concave groove.

16. The hinge assembly of claim 10 wherein the second side of the clamping member has a series of projections extending outwardly therefrom to interact with the gasket and provide improved clamping of the panel.

17. The hinge assembly of claim 10 wherein the gasket has a first lip extending from a free end of the first side member, the first lip sized to extend over the clamping member and cover a free end of the first side wall of the shoe; and wherein the gasket has a second lip extending from a free end of the second side wall, the second lip sized to cover a free end of the second side wall of the shoe.

18. A hinge assembly for a glass shower door panel, comprising:

a shoe having a base member and first and second side walls forming a first channel extending along a longitudinal axis of the shoe, the first side wall defining a plurality of threaded apertures extending parallel to a lateral axis of the shoe, the first side wall having an interior surface with first and second inclined planes extending longitudinally and on either side of the apertures, wherein a first vector normal to the first inclined plane has a component perpendicular to the lateral and longitudinal axes, and wherein a second vector normal to the second inclined plane has a component perpendicular to the lateral and longitudinal axes;

a gasket forming a second channel sized to receive a glass panel and sized to be received within the first channel;

a clamping bracket formed by a member having a first side and a second opposed side, the first side having a third and fourth inclined planes extending longitudinally and shaped to engage with the first inclined and second inclined planes; and a plurality of threaded fasteners sized to be received in the threaded apertures.

19. A hinge assembly of claim 18 wherein a rotational motion of a panel within the gasket about the lateral axis is configured to provide a frictional force between the gasket and the clamping bracket to force the inclined planes of the bracket against the inclined planes of the shoe, thereby moving the bracket in a lateral direction towards the panel to provide additional clamping force on the panel.

20. The hinge assembly of claim 18 wherein the first and second vectors each have another component parallel with the lateral axis of the shoe.

* * * * *